US012168167B2

(12) United States Patent
Rittmann

(10) Patent No.: US 12,168,167 B2
(45) Date of Patent: Dec. 17, 2024

(54) GOLF CLUB HEAD COVER DEVICE

(71) Applicant: Kenneth W. Rittmann, Naples, FL (US)

(72) Inventor: Kenneth W. Rittmann, Naples, FL (US)

(73) Assignee: Kenneth W. Rittmann, Naples, FL (US)

( * ) Notice: Subject to any disclaimer, the term of this patent is extended or adjusted under 35 U.S.C. 154(b) by 45 days.

(21) Appl. No.: 18/095,888

(22) Filed: Jan. 11, 2023

(65) Prior Publication Data

US 2024/0226682 A1 Jul. 11, 2024

(51) Int. Cl.
*A63B 60/62* (2015.01)

(52) U.S. Cl.
CPC ..... *A63B 60/62* (2015.10)

(58) Field of Classification Search
CPC ..... A63B 60/62
USPC ..... 150/160
See application file for complete search history.

(56) References Cited

U.S. PATENT DOCUMENTS

| | | | | |
|---|---|---|---|---|
| 3,398,961 A | | 8/1968 | Higdon | |
| 3,426,815 A | * | 2/1969 | Ashlin | A63B 60/62 150/160 |
| 3,593,769 A | | 7/1971 | Spears | |
| 3,997,169 A | | 12/1976 | Bergstrom | |
| 4,119,129 A | * | 10/1978 | Freiberg | A63B 60/62 150/160 |
| 4,667,716 A | | 5/1987 | Solheim et al. | |
| 5,611,379 A | * | 3/1997 | Hoyt | B29C 63/22 150/160 |
| 5,941,293 A | * | 8/1999 | Serpa | A63B 60/62 150/160 |
| D444,525 S | * | 7/2001 | Bernath | D21/754 |
| 6,321,805 B1 | | 11/2001 | Suggs | |
| D470,206 S | | 2/2003 | Bergling-Olson | |
| D479,292 S | | 9/2003 | Bergling-Olson | |
| 7,464,812 B2 | | 12/2008 | Wright et al. | |
| 7,954,526 B2 | | 6/2011 | Chen | |
| 8,276,627 B2 | | 10/2012 | Gaffney | |
| 9,604,109 B2 | | 3/2017 | Gaffney | |
| 9,610,484 B2 | | 4/2017 | Gaffney | |
| 9,950,229 B2 | * | 4/2018 | Lee | A63B 60/62 |
| 10,537,776 B2 | | 1/2020 | Gaffney | |

(Continued)

FOREIGN PATENT DOCUMENTS

| | | | | |
|---|---|---|---|---|
| GB | 2133700 A | * | 8/1984 | A63B 60/62 |
| GB | 2357438 A | * | 6/2001 | A63B 60/62 |

(Continued)

OTHER PUBLICATIONS

Pacific Golf Clubs Putter Cover: https://www.amazon.com/Golf-Headcover-Neoprene-Perfect-Clubs/dp/B00XQGKM8K (Year: 2015).*

(Continued)

*Primary Examiner* — Don M Anderson
*Assistant Examiner* — Justin Caudill
(74) *Attorney, Agent, or Firm* — ICE MILLER LLP

(57) ABSTRACT

A tubular golf club head cover device, with at least one open end for insertion and extraction of a golf club head. A notch and semi-rigid flap exist on one end of the tubular shape that allow for insertion of the golf club head and the self-latching of the club into the golf club head cover device.

18 Claims, 7 Drawing Sheets

(56) References Cited

U.S. PATENT DOCUMENTS

| | | | | |
|---|---|---|---|---|
| 2003/0136485 | A1* | 7/2003 | Bradshaw | A63B 60/62 150/160 |
| 2007/0068611 | A1 | 3/2007 | Hwang | |
| 2007/0178989 | A1 | 8/2007 | Wright et al. | |
| 2009/0205760 | A1* | 8/2009 | Bettinardi | A63B 60/62 150/160 |
| 2014/0202603 | A1* | 7/2014 | Huang | A63B 60/62 150/160 |
| 2021/0354013 | A1* | 11/2021 | Bailey | A63B 60/62 |

FOREIGN PATENT DOCUMENTS

| | | | | |
|---|---|---|---|---|
| JP | 2001353245 | A | 12/2001 | |
| KR | 200493572 | Y1 * | 4/2001 | A63B 60/62 |

OTHER PUBLICATIONS

International Search Report and Written Opinion dated May 10, 2023 in International Application No. PCT/US23/13283.

* cited by examiner

GOLF CLUB HEAD COVER DEVICE

BACKGROUND

Golf clubs are most often transported in a golf bag, which would normally hold an entire set of golf clubs. Golf club heads are exposed to potential damage when transported in close proximity to other hard objects, such as other golf club heads, as they are made from materials that may be dented, dinged, or scratched. Golf club heads are most likely to be damaged by other golf club heads that may impact each other while they are transported in the golf bag.

For the foregoing reasons, it is desired to provide a device for protecting a golf club head from damage.

SUMMARY

The present disclosure includes disclosure of golf club head cover devices. In at least one embodiment, a golf club head cover device according to the present disclosure comprises a sheet material, the sheet material having an irregular shape and comprising a first edge and a second edge opposite the first edge, the second edge comprising a notch and a flap adjacent to the notch, wherein when the first edge and the second edge are coupled the sheet material takes on a tubular shape having a heel opening and a toe opening at opposite ends of the tubular shape, the flap overlays the first edge, and the notch is open to an interior of the tubular shape.

In at least one embodiment, a golf club head cover device according to the present disclosure is used with a golf club comprising a shaft fixedly coupled to a head directly or by way of a neck, the head comprising a toe and a heel, wherein the head has been inserted into the tubular shape, with the toe of the head being inserted into the heel opening of the tubular shape and urged toward the toe opening of the tubular shape until the shaft or neck passes the flap and is captured by the notch.

In at least one embodiment of a golf club head cover device according to the present disclosure, the flap comprises a border adjacent the notch, and wherein the coupling of the first edge and the second edge results in a seam, and wherein an angle formed by the border and a line extending from the seam is greater than or equal to 90 degrees. In at least one embodiment, the angle is about 100 degrees. In at least one embodiment, the angle is about 110 degrees.

In at least one embodiment of a golf club head cover device according to the present disclosure, the sheet material comprises a semi-rigid material.

In at least one embodiment of a golf club head cover device according to the present disclosure, the sheet material comprises two or more layers.

In at least one embodiment of a golf club head cover device according to the present disclosure, the flap comprises a reinforcing element.

In at least one embodiment of a golf club head cover device according to the present disclosure, the sheet material further comprises a leading edge connecting the first edge and the second edge, the leading edge comprising a curvilinear segment, wherein when the sheet material is formed into the tubular shape the curvilinear segment forms a tab adjacent to the toe opening.

In at least one embodiment of a golf club head cover device according to the present disclosure, the sheet material further comprises a trailing edge connecting the first edge and the second edge, the trailing edge comprising a curvilinear segment, wherein when the sheet material is formed into the tubular shape the curvilinear segment forms a tab adjacent to the heel opening.

In at least one embodiment, a golf club head cover device according to the present disclosure comprises a tubular material having a heel opening and a toe opening at opposite ends of the tubular material, the heel opening and the toe opening being unobstructed; a notch in the tubular material, the notch being open to an interior of the tubular material; a gap in the tubular material; the gap extending between the heel opening and the notch, the gap being open to an interior of the tubular material; and a flap in the tubular material adjacent to the notch, the flap overlaying the gap, the flap comprising a border that is oriented toward the notch.

In at least one embodiment, a golf club head cover device according to the present disclosure is used with a golf club comprising a shaft fixedly coupled to a head directly or by way of a neck, the head comprising a toe and a heel, wherein the head has been inserted into the tubular material, with the toe of the head being inserted into the heel opening of the tubular material and urged toward the toe opening of the tubular material until the shaft or neck passes the flap and is captured by the notch and the border.

In at least one embodiment of a golf club head cover device according to the present disclosure, the flap comprises a border adjacent the notch, and wherein the tubular material comprises an axis, and wherein an angle formed by the axis and a line extending from the border is greater than or equal to 90 degrees. In at least one embodiment, the angle is about 100 degrees. In at least one embodiment, the angle is about 110 degrees.

In at least one embodiment of a golf club head cover device according to the present disclosure, the tubular material comprises a semi-rigid material.

In at least one embodiment of a golf club head cover device according to the present disclosure, the tubular material comprises two or more layers.

In at least one embodiment of a golf club head cover device according to the present disclosure, the flap comprises a reinforcing element.

In at least one embodiment of a golf club head cover device according to the present disclosure, the toe opening comprises an external tab adjacent to the toe opening.

In at least one embodiment of a golf club head cover device according to the present disclosure, the heel opening comprises an external tab adjacent to the heel opening.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

Figure 1A:
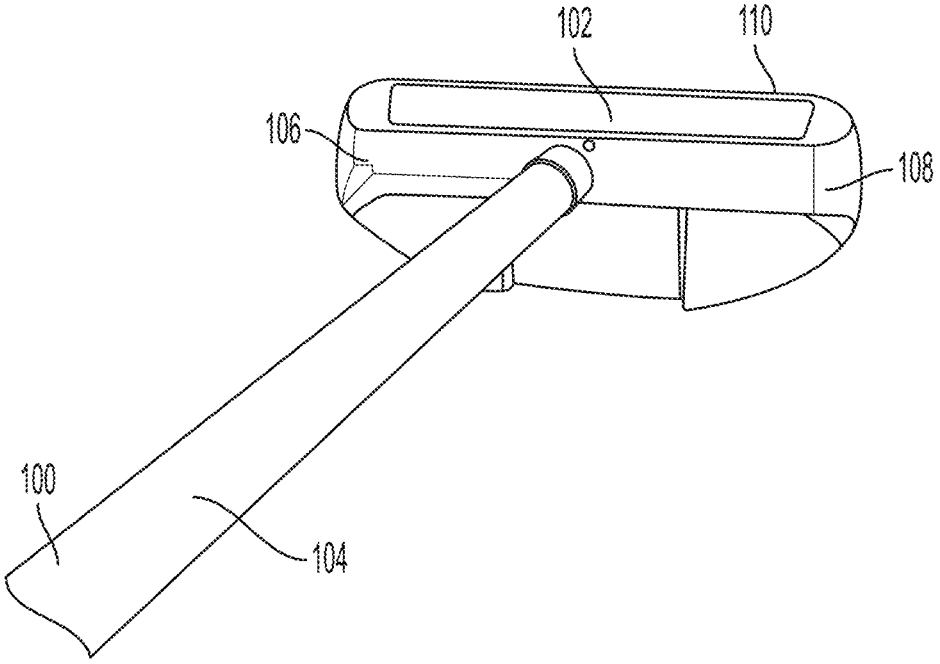
FIG. 1A PRIOR ART
FIG. 1A shows an overhead view of a golf club according to the prior art.

These drawings may not be drawn to scale and may not precisely reflect structure or performance characteristics of any given embodiment, and should not be interpreted as defining or limiting the range of values or properties encompassed by example embodiments.

DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

As used throughout this application, the word "may" is used in a permissive sense (i.e., meaning having the potential to), rather than the mandatory sense (i.e., meaning must). The words "include," "including," and "includes" and the like mean including, but not limited to. As used herein, the singular form of "a," "an," and "the" include plural references unless the context clearly dictates otherwise. As employed herein, the term "number" shall mean one or an integer greater than one (i.e., a plurality).

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

FIG. 1A shows an overhead view of a golf club according to the prior art. Shown in FIG. 1A is golf club 100 comprising head 102 fixedly coupled to shaft 104. As shown in FIG. 1A, head 102 comprises heel 106, toe 108, and sole 110. Sole 110 is not visible in FIG. 1A.

Figure 1B:
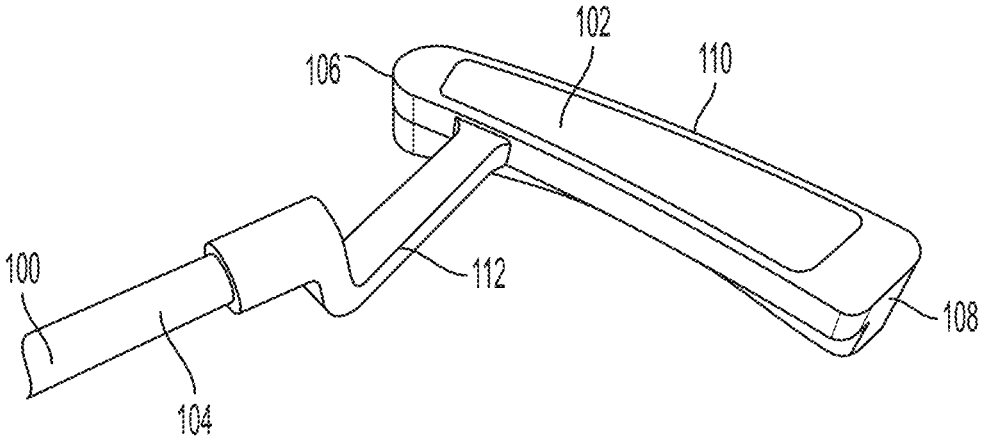
FIG. 1B PRIOR ART
FIG. 1B shows an overhead view of a golf club according to the prior art.

FIG. 1B shows an overhead view of another golf club according to the prior art. Shown in FIG. 1B is golf club 100 comprising head 102 and shaft 104. As shown in FIG. 1B, head 102 is fixedly coupled to shaft 104 by way of a neck 112 between head 102 and shaft 104. As shown in FIG. 1B, head 102 comprises heel 106, toe 108, and sole 110. Sole 110 is not visible in FIG. 1B.

The "lie angle" of a golf club, such as golf club 100, is the angle between the straight portion of the golf club shaft (such as shaft 104) and the horizontal ground when the golf head (head 102) is placed in its normal address position in preparation for striking a golf ball. The lie angle of a golf club is typically between 70 degrees to 72 degrees. Under the rules that are in effect on the date of this application, the lie angle of a golf club must be no more than 80 degrees.

Figure 2:
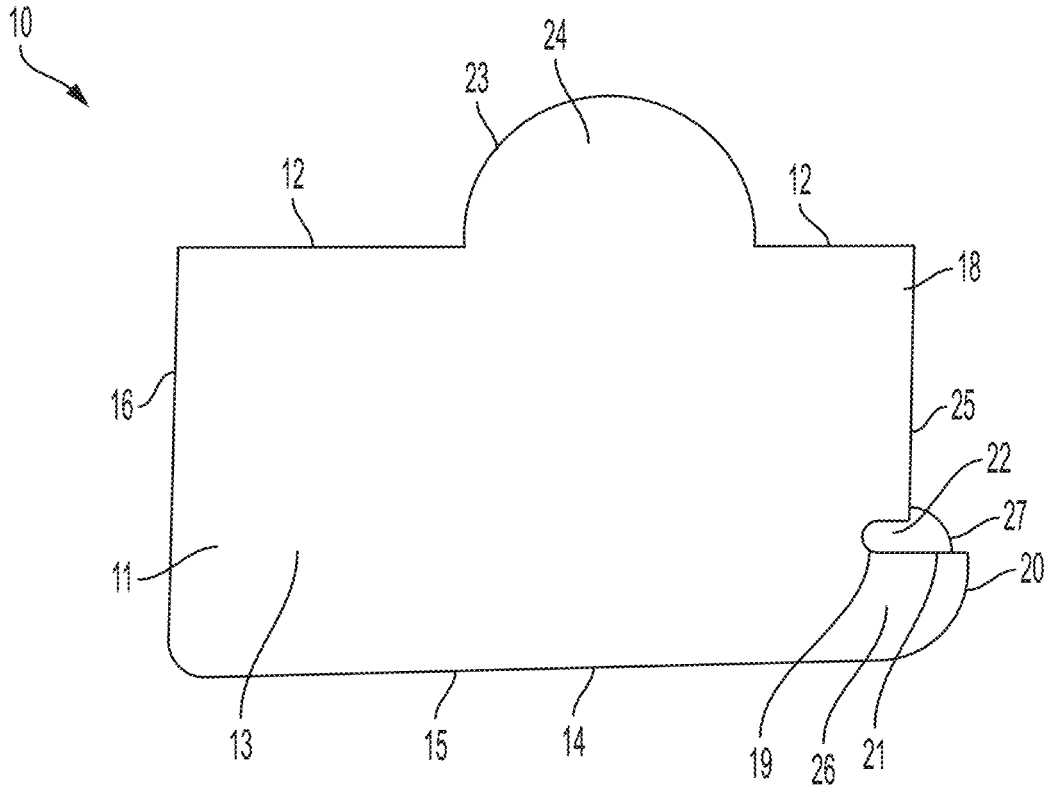
FIG. 2 shows an overhead view of an unconstructed golf club head cover device according to at least one embodiment of the present disclosure.

FIG. 2 shows an overhead view of an unconstructed golf club head cover device according to at least one embodiment of the present disclosure. Shown in FIG. 2 is golf club head cover device material 11, according to at least one embodiment of the present disclosure. In at least one embodiment of the present disclosure, golf club head cover device material 11 comprises a sheet of a semi-rigid material. Golf club head cover device material 11 should be pliable enough to be formed into golf club head cover device 10 as described hereinafter. Golf club head cover device material 11 should be rigid enough to retain and protect a golf club that is inserted into golf club head cover device 10 as described hereinafter. In at least one embodiment of the present disclosure, golf club head cover device material 11 comprises an animal hide material. In at least one embodiment of the present disclosure, golf club head cover device material 11 comprises a plastic material. In at least one embodiment of the present disclosure, golf club head cover device material 11 comprises an EVA foam material. In at least one embodiment of the present disclosure, golf club head cover device material 11 comprises a layered material. In at least one embodiment of the present disclosure, golf club head cover device material 11 comprises a plurality of different materials coupled together.

In at least one embodiment of the present disclosure, golf club head cover device material 11 comprises a sheet material having outer surface 13 and an inner surface 15 (not visible in FIG. 2), and comprises an irregular shape. As shown in FIG. 2, golf club head cover device material 11 is bounded by leading edge 12, trailing edge 14, first side edge 16, and second side edge 18.

In at least one embodiment of the present disclosure, leading edge 12 optionally comprises a curvilinear segment 23, which forms tab 24 in golf club head cover device material 11. In at least one embodiment of the present disclosure, second side edge 18 comprises a straight portion 25 and a curvilinear segment 19, which forms notch 22 in golf club head cover device material 11. In at least one embodiment of the present disclosure, second side edge 18 further comprises a curvilinear segment 20, which forms flap 26 in golf club head cover device material 11. In at least one embodiment of the present disclosure, flap 26 comprises border 21, which is oriented toward notch 22.

Reference numeral 27 in FIG. 2 refers to the angle formed by the intersection of border 21 and an imaginary line extending from straight portion 25. In at least one embodiment of the present disclosure, angle 27 equals 180 degrees minus the lie angle of the golf club with which golf club head cover device 10 is intended to be used. In at least one embodiment of the present disclosure, angle 27 is about 90 degrees. In at least one embodiment of the present disclosure, angle 27 is about 100 degrees. In at least one embodiment of the present disclosure, angle 27 is about 110 degrees.

Figure 3:
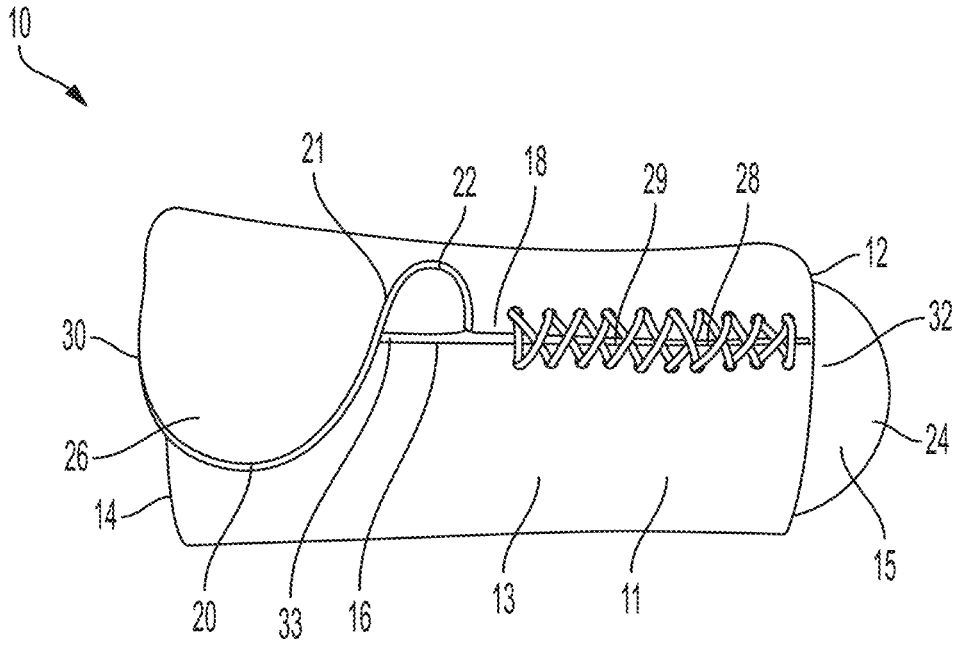
FIG. 3 shows an overhead view of a golf club head cover device according to at least one embodiment of the present disclosure.

FIG. 3 shows an overhead view of a golf club head cover device 10 according to at least one embodiment of the present disclosure. As shown in FIG. 3, golf club head cover device 10 is constructed by forming golf club head cover device material 11 into a tubular shape. The tubular shape of golf club head cover device 10 may or may not have a circular cross-section. First side edge 16 and second side edge 18 are brought into contact with each other, and coupled together to form seam 29. In at least one embodiment, seam 29 is substantially parallel to the axis of golf club head cover device 10. According to at least one embodiment of the present disclosure, first side edge 16 and second side edge 18 may be coupled together using stiches 28. Other methods of coupling first side edge 16 and second side edge 18 such as, but not limited to, ultrasonic welding, staples, and/or adhesives may be used in conjunction with, or in place of, stiches 28.

As shown in FIG. 3, golf club head cover device 10 comprises notch 22, through which inner surface 15 is visible. As shown in FIG. 3, golf club head cover device 10 also comprises flap 26, which extends over the corresponding part of first side edge 16. As shown in FIG. 3, first side edge 16 and second side edge 18 are not coupled in the area of notch 22 or flap 26, which results in gap 33 that extends from heel opening 30 to notch 22. Flap 26 covers gap 33. As shown in FIG. 3, the tubular shape of golf club head cover device 10 results in heel opening 30 and toe opening 32 at opposite ends of golf club head cover device 10, and a passageway through golf club head cover device 10 from heel opening 30 to toe opening 32. Optionally, tab 24 may be arranged over toe opening 32 and coupled to leading edge 12 so as to cover toe opening 32.

Figure 4:
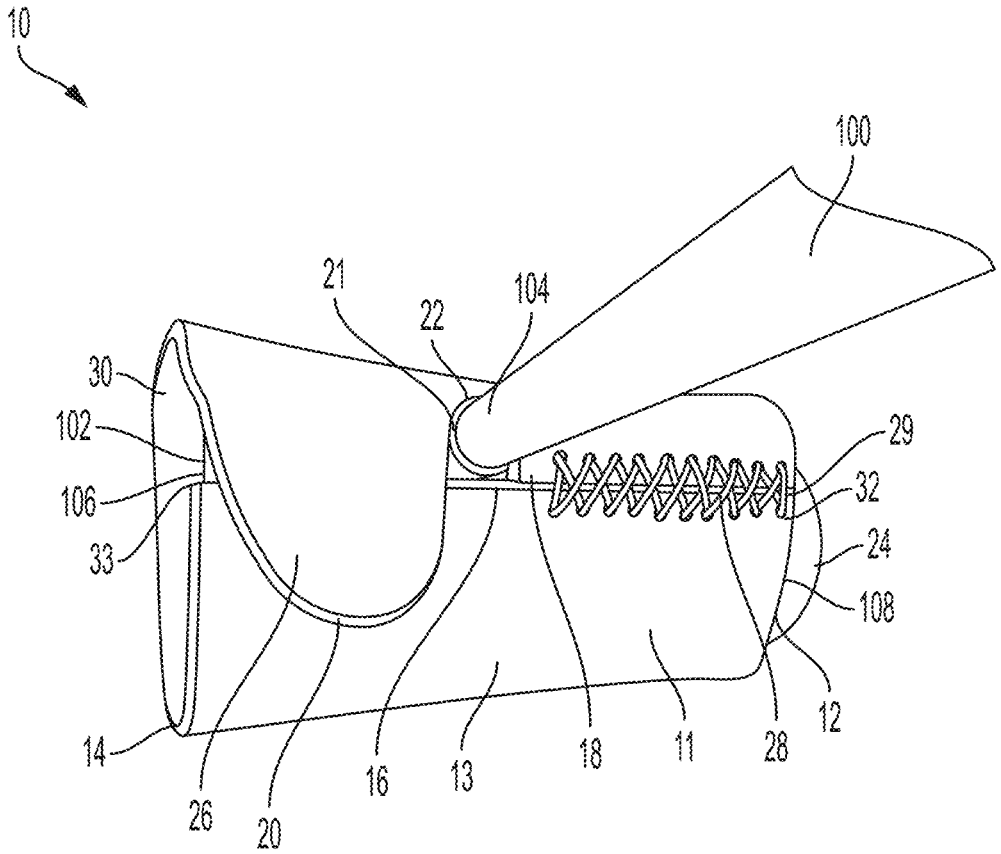
FIG. 4 shows an overhead view of a golf club head cover device according to at least one embodiment of the present disclosure.
Figure 5:
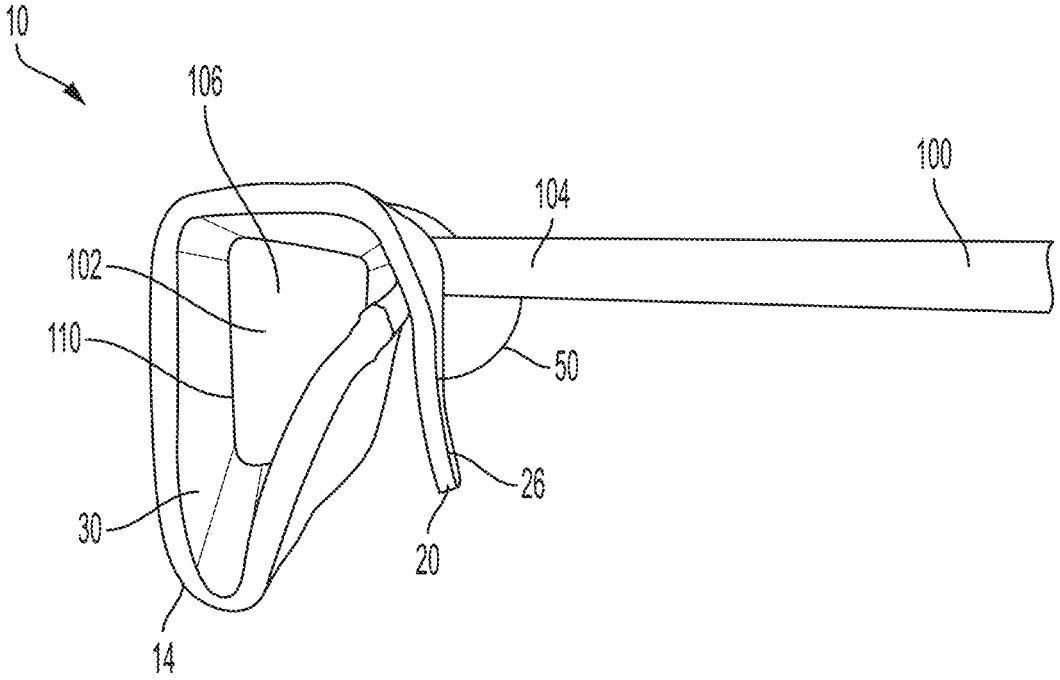
FIG. 5 shows an end view of a golf club head cover device according to at least one embodiment of the present disclosure.

FIG. 4 shows an overhead view of a golf club head cover device according to at least one embodiment of the present disclosure. FIG. 5 shows an end view of a golf club head cover device according to at least one embodiment of the present disclosure. FIGS. 4-5 shows golf club head cover device 10 in use with golf club 100. As shown in FIGS. 4-5, head 102 of golf club 100 is inserted through heel opening 30. As head 102 of golf club 100 is urged toward toe opening 32, shaft 104 is forced against flap 26. Flap 26 is temporarily displaced by shaft 104, which allows shaft 104 of golf club 100 to pass by flap 26 and pass through gap 33. After shaft 104 of golf club 100 passes flap 26 and passes through gap 33, flap 26 returns to its original orientation, closing behind shaft 104 and retaining shaft 104 in notch 22. Border 21 of flap 26 is adjacent to shaft 104. Head 102 of golf club 100 is concealed within golf club head cover device 10. If golf club 100 comprises neck 112, as shown in FIG. 1B, then it will be neck 112 rather than shaft 104 that is forced against and displaces flap 26 and is retained in notch 22.

To remove golf club 100 from golf club head cover device 10, flap 26 is temporarily displaced, such as by action of the user's thumb or fingers. Temporary displacement of flap 26 allows shaft 104 to be released from notch 22. Shaft 104 passes through gap 33 toward heel opening 30. Head 102 of golf club 100 is removed through heel opening 30. In an embodiment of golf club head cover device 10 comprising tab 24, a user may gain additional leverage when removing golf club 100 from golf club head cover device 10 by gripping tab 24 while head 102 of golf club 100 is being removed through heel opening 30. If golf club 100 comprises neck 112, as shown in FIG. 1B, then it will be neck 112 rather than shaft 104 that is released from notch 22 and passes through gap 33.

Golf club head cover device 10 optionally may be configured with a tab similar to tab 24, but located adjacent to heel opening 30. In an embodiment of golf club head cover device 10 comprising such a tab adjacent to heel opening 30, a user may gain additional leverage when inserting golf club 100 into golf club head cover device 10 by gripping the tab adjacent to heel opening 30 while head 102 of golf club 100 is being inserted into heel opening 30.

Flap 26 must be sufficiently pliable to be temporarily displaceable to allow shaft 104 or neck 112 of golf club 100 to pass by flap 26. Golf club head cover device 10 is free of any fasteners, magnets, hook and loop material, or other closure devices that affix flap 26 to the corresponding portion of outer surface 13 that is overlapped by flap 26. Flap 26 must be sufficiently rigid to retain shaft 104 or neck 112 within notch 22 without the aid of such fasteners, magnets, hook and loop material, or other closure devices. In at least one embodiment golf club head cover device 10 according to the present disclosure, flap 26 may comprise a reinforcing element to augment the rigidity of the golf club head cover device material 11 from which flap 26 is formed. Such a reinforcing element may comprise a metal or plastic piece that is inserted within the area of golf club head cover device material 11 from which flap 26 is formed. Such a reinforcing element may comprise a metal or plastic piece that coupled to outer surface 13 and/or inner surface 15 in the area of golf club head cover device material 11 from which flap 26 is formed. In at least one embodiment of the present disclosure, golf club head cover device material 11 comprises a flexible material, with a different semi-rigid material in the area of golf club head cover device material 11 from which flap 26 is formed. In at least one embodiment of the present disclosure where golf club head cover device material 11 comprises two or more layers of materials, a semi-rigid material may be installed in between two layers in the area of flap 26.

In at least one embodiment, border 21 of flap 26 is approximately perpendicular to second side edge 18. However, the angle between border 21 of flap 26 and second side edge 18 may be configured to adjust the golf club retention characteristics of golf club head cover device 10. Decreases in that angle may make golf club head cover device 10 retain golf club 100 more securely, but also may increase the difficulty of removing golf club 100 from golf club head cover device 10. Increases in that angle may improve the removability of golf club 100 from golf club head cover device 10, but may make golf club head cover device 10 retain golf club 100 less securely. The desired resistance to the removal of golf club 100 from golf club head cover device 10 can be adjusted by the angle between border 21 of flap 26 and second side edge 18.

Returning to FIG. 5, reference numeral 50 refers to the angle between flap 26 and shaft 104, when golf club head cover device 10 is viewed from the heel end as in FIG. 5. Angle 50 may be configured to adjust the golf club retention characteristics of golf club head cover device 10. Increases in angle 50 may make golf club head cover device 10 retain golf club 100 more securely, but also may increase the difficulty of removing golf club 100 from golf club head cover device 10. Decreases in angle 50 may improve the removability of golf club 100 from golf club head cover device 10, but may make golf club head cover device 10 retain golf club 100 less securely. In at least one embodiment of the present disclosure, angle 50 is less than or equal to 90 degrees. In at least one embodiment of the present disclosure, angle 50 is less than or equal to 60 degrees. In at least one embodiment of the present disclosure, angle 50 is less than or equal to 45 degrees. In at least one embodiment of the present disclosure, angle 50 is less than or equal to 30 degrees.

Figure 6:
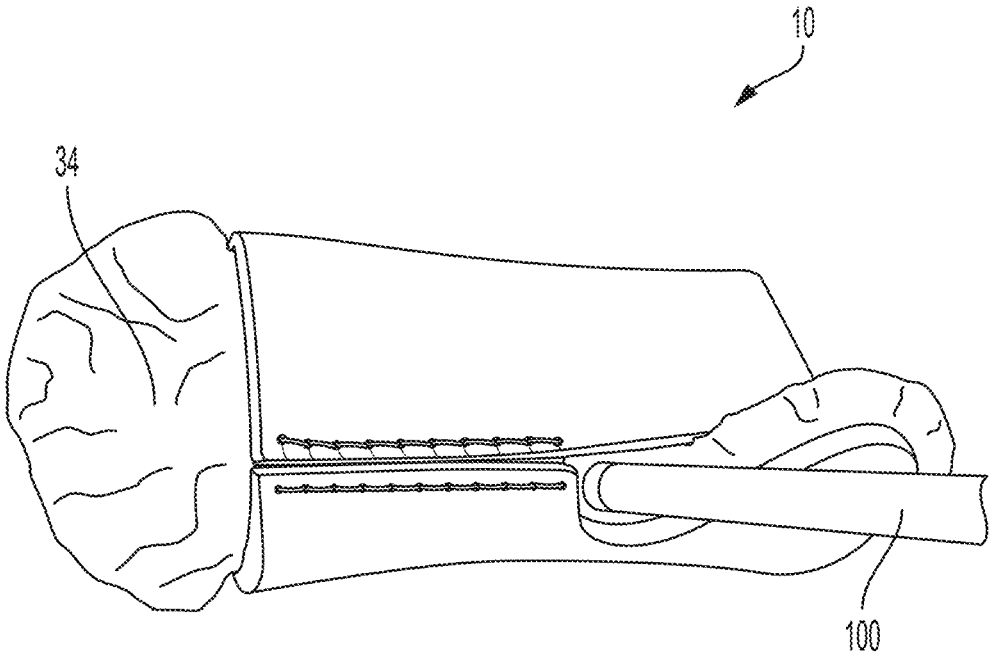
FIG. 6 shows an overhead view of a golf club head cover device according to at least one embodiment of the present disclosure.

FIG. 6 shows an overhead view of a golf club head cover device 10 according to at least one embodiment of the present disclosure. As shown in FIG. 6, optional liner material 34 has been applied to inner surface 15 of golf club head cover device material 11 prior to forming golf club head cover device material 11 into a tubular shape. Liner material 34 may comprise wool, leather, cotton, a synthetic material, and the like. Liner material 34 may comprise a moisture absorbing material. Liner material 34 may provide additional protection for golf club head 102 when it is inside of golf club head cover device 10.

In at least one embodiment of the present disclosure, golf club head cover device 10 is constructed from a single piece of material with only one seam, simplifying the steps of constructing golf club head cover device 10. More seams and other materials may be added to provide for aesthetics, but are not needed for the function of golf club head cover device 10.

Golf club head cover device 10 according to the present disclosure may be produced from any material with an integral flap 26, or have a flap 26 added, inserted, or combined with such material whereby the area of flap 26 is sufficiently pliable to be temporarily displaced to allow shaft 104 or neck 112 of golf club 100 to pass by flap 26, and also sufficiently rigid to retain shaft 104 or neck 112 in notch 22. Golf club head cover device 10 according to the present disclosure may be constructed with many layers of materials or just one layer of material.

While this disclosure has been described as having preferred designs, the apparatus and methods according to the present disclosure can be further modified within the scope and spirit of this disclosure. This application is therefore intended to cover any variations, uses, or adaptations of the disclosure using its general principles. For example, any method disclosed herein and in the appended claims represents one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

I claim:

1. A golf club head cover device comprising:

a sheet material, said sheet material comprising a first edge and a second edge opposite said first edge, said second edge comprising a notch and a flap adjacent to said notch, wherein when said first edge and said second edge are fixedly coupled in an edge-to-edge orientation, said sheet material takes on a tubular shape having a heel opening and a toe opening at opposite ends of said tubular shape, said flap overlays said first edge, and said notch is open to an interior of said tubular shape.

2. The golf club head cover device of claim 1, further comprising:

a golf club comprising a shaft fixedly coupled to a head directly or by way of a neck, said head comprising a toe and a heel, wherein said head has been inserted into said tubular shape, with said toe of said head being inserted into said heel opening of said tubular shape and urged toward said toe opening of said tubular shape until said shaft or said neck passes said flap and is captured by said notch.

3. The golf club head cover device of claim 1, wherein said flap comprises a border adjacent said notch, and wherein the coupling of said first edge and said second edge results in a seam, and wherein an angle formed by said border and a line extending from said seam is greater than or equal to 90 degrees.

4. The golf club head cover device of claim 3, wherein said angle is about 100 degrees.

5. The golf club head cover device of claim 3, wherein said angle is about 110 degrees.

6. The golf club head cover device of claim 1, wherein said sheet material comprises a semi-rigid material.

7. The golf club head cover device of claim 1, wherein said sheet material comprises two or more layers.

8. The golf club head cover device of claim 1, wherein said sheet material further comprises a leading edge connecting said first edge and said second edge, said leading edge comprising a curvilinear segment, wherein when said sheet material is formed into said tubular shape said curvilinear segment forms a tab adjacent to said toe opening.

9. The golf club head cover device of claim 1, wherein said sheet material further comprises a trailing edge connecting said first edge and said second edge, said trailing edge comprising a curvilinear segment, wherein when said sheet material is formed into said tubular shape said curvilinear segment forms a tab adjacent to said heel opening.

10. A golf club head cover device comprising:

a tubular material having a heel opening and a toe opening at opposite ends of said tubular material, said heel opening and said toe opening being unobstructed, said tubular material being constructed of a sheet material formed into a tubular shape, said sheet material having at least a first edge and a second edge, wherein said first edge and said second edge are fixedly coupled in an edge-to-edge orientation to create said tubular shape;

a notch in said tubular material, said notch being open to an interior of said tubular material;

a gap in said tubular material; said gap extending between said heel opening and said notch, said gap being open to an interior of said tubular material; and a flap in said tubular material adjacent to said notch, said flap overlaying said gap, said flap comprising a border that is oriented toward said notch.

11. The golf club head cover device of claim 10, further comprising:

a golf club comprising a shaft fixedly coupled to a head directly or by way of a neck, said head comprising a toe and a heel, wherein said head has been inserted into said tubular material, with said toe of said head being inserted into said heel opening of said tubular material and urged toward said toe opening of said tubular material until said shaft or said neck passes said flap and is captured by said notch and said border.

12. The golf club head cover device of claim 10, wherein said flap comprises a border adjacent said notch, and wherein said tubular material comprises an axis, and wherein an angle formed by said axis and a line extending from said border is greater than or equal to 90 degrees.

13. The golf club head cover device of claim 12, wherein said angle is about 100 degrees.

14. The golf club head cover device of claim 12, wherein said angle is about 110 degrees.

15. The golf club head cover device of claim 10, wherein said tubular material comprises a semi-rigid material.

16. The golf club head cover device of claim 10, wherein said tubular material comprises two or more layers.

17. The golf club head cover device of claim 10, wherein said toe opening comprises an external tab adjacent to said toe opening.

18. The golf club head cover device of claim 10, wherein said heel opening comprises an external tab adjacent to said heel opening.

* * * * *